US009395058B2

(12) United States Patent
Van Herpen

(10) Patent No.: US 9,395,058 B2
(45) Date of Patent: Jul. 19, 2016

(54) STACK ARRANGEMENT COMPRISING A LIGHTING UNIT IN BETWEEN A SUPPORT AND A SUPPORT COVER

(75) Inventor: Maarten Marinus Johannes Wilhelmus Van Herpen, Heesch (NL)

(73) Assignee: Koniklijke Philips Electronics N.V., Eindhoven (NL)

( * ) Notice: Subject to any disclaimer, the term of this patent is extended or adjusted under 35 U.S.C. 154(b) by 88 days.

(21) Appl. No.: 13/805,074

(22) PCT Filed: Jun. 16, 2011

(86) PCT No.: PCT/IB2011/052631

§ 371 (c)(1),
(2), (4) Date: Dec. 18, 2012

(87) PCT Pub. No.: WO2011/161593

PCT Pub. Date: Dec. 29, 2011

(65) Prior Publication Data

US 2013/0120975 A1 May 16, 2013

(30) Foreign Application Priority Data

Jun. 23, 2010 (EP) ..... 10166997

(51) Int. Cl.
*F21S 8/02* (2006.01)
*F21S 8/00* (2006.01)
(Continued)

(52) U.S. Cl.
CPC ... *F21S 8/00* (2013.01); *E04B 1/00* (2013.01); *F21S 8/04* (2013.01); *F21V 33/006* (2013.01); *G09F 9/33* (2013.01); *G09F 19/22* (2013.01); *G09F 19/228* (2013.01);
(Continued)

(58) Field of Classification Search
CPC ..... F21S 8/022; F21S 8/024; F21S 8/026; F21S 8/028; F21S 8/03; F21S 8/032; F21S 8/033; F21S 8/00; F21S 8/04; F21S 4/22; F21S 4/24; F21S 4/26; F21S 4/28; E04B 1/00; F21V 33/06; F21V 7/16; F21V 2008/006; G09F 19/22; G09F 19/228; G09F 9/33; G09F 2019/225
USPC ..... 362/147, 153, 153.1
See application file for complete search history.

(56) References Cited

U.S. PATENT DOCUMENTS 4,737,764 A * 4/1988 Harrison ..... 362/153
6,231,206 B1 * 5/2001 Hervey et al. ..... 362/153
(Continued)

FOREIGN PATENT DOCUMENTS

CN 101133925 A 3/2008
DE 20004992 U1 7/2001
(Continued)

*Primary Examiner* — Evan Dzierzynski
*Assistant Examiner* — Matthew Peerce

(57) ABSTRACT

The invention provides a stack arrangement (100) comprising a support (30) and a support cover (20). The support cover (20) may be wall paper, and carpet, PVC flooring, linoleum flooring and plaster. At a position (1) between the support (30) and the support cover (20) a lighting unit (10) is configured to provide light (15) through the support cover (20). The support cover (20) and the support (30) are adhesively bonded to each other. The lighting unit (10) is releasably bonded to at least one of the support (30) and the support cover (20) via a release liner unit (40). The release liner unit (40) comprises a release liner (141) for releasable binding.

8 Claims, 8 Drawing Sheets

(51) Int. Cl.

| | |
|---|---|
| ***F21V 33/00*** | (2006.01) |
| ***G09F 9/33*** | (2006.01) |
| ***G09F 19/22*** | (2006.01) |
| ***E04B 1/00*** | (2006.01) |
| ***F21S 8/04*** | (2006.01) |
| *F21Y 101/02* | (2006.01) |

(52) U.S. Cl.
CPC ..... *E04F 2290/026* (2013.01); *F21Y 2101/02* (2013.01); *G09F 2019/225* (2013.01); *Y10T 29/49826* (2015.01)

(56) References Cited

U.S. PATENT DOCUMENTS

| | | | | |
|---|---|---|---|---|
| 7,549,784 | B1 * | 6/2009 | Teeters | 362/576 |
| 8,109,644 | B2 * | 2/2012 | Bierhuizen | 362/97.3 |
| 8,235,542 | B2 * | 8/2012 | Yohananoff | 362/153.1 |
| 8,444,294 | B1 * | 5/2013 | Hawkins | 362/234 |
| 2001/0036072 | A1 * | 11/2001 | Baker | 362/146 |
| 2002/0039290 | A1 * | 4/2002 | Lemmens | A41D 27/085 362/249.01 |
| 2005/0053436 | A1 * | 3/2005 | Atkins | 408/204 |
| 2006/0015663 | A1 * | 1/2006 | Dietz et al. | 52/403.1 |
| 2006/0082987 | A1 * | 4/2006 | Dorsey et al. | 362/103 |
| 2006/0156663 | A1 * | 7/2006 | Mao | 52/403.1 |
| 2007/0133193 | A1 * | 6/2007 | Kim | 362/147 |
| 2007/0153502 | A1 * | 7/2007 | Arriazu | 362/152 |
| 2008/0253111 | A1 * | 10/2008 | Kotulla | 362/147 |
| 2008/0254253 | A1 | 10/2008 | Gallager | |
| 2009/0117312 | A1 | 5/2009 | Hanelt et al. | |

FOREIGN PATENT DOCUMENTS

| | | | |
|---|---|---|---|
| EP | 0323682 | A1 | 7/1989 |
| WO | 2007081254 | A1 | 7/2007 |
| WO | 2009066216 | A1 | 5/2009 |
| WO | 2009066224 | A1 | 5/2009 |
| WO | 2009066226 | A1 | 5/2009 |
| WO | 2010052606 | A3 | 5/2010 |
| WO | 2010092520 | A1 | 8/2010 |

* cited by examiner

STACK ARRANGEMENT COMPRISING A LIGHTING UNIT IN BETWEEN A SUPPORT AND A SUPPORT COVER

FIELD OF THE INVENTION

The invention relates to stack arrangement comprising a lighting unit in between a support and a support cover. The invention also relates to a support cover and a lighting unit for use in such a stack arrangement, as well as to a method of approaching a lighting unit embedded in such a stack arrangement. The invention also relates to a method for the production of such a stack arrangement.

BACKGROUND OF THE INVENTION

Carpets with lighting functions are known in the art. For instance, WO-2009/066216 describes a light emitting tufted carpet with a primary backing layer permeable to light, an optional adhesive layer, a waveguide comprising a light outcoupling site, and an optional secondary backing layer. The primary backing layer is provided with tufts. The waveguide is arranged to couple light source light of a light source in as waveguide light, and arranged to couple waveguide light out at the waveguide light outcoupling site to provide carpet light. The waveguide light outcoupling site is below the primary backing layer.

U.S. Pat. No. 4,737,764 describes an apparatus for guiding the occupants of a structure along a path of travel within the structure is provided. The apparatus is comprised of modular floor covering units which are abuttingly arranged to cover the floor of the structure, with some of the units being signal units having a light transmissive housing positioned in an opening therein, and having light emitting means positioned in the housing. Power means are provided to energize the light emitting means, and thereby provide a visually discernable pathway on the floor. The floor covering units preferably comprise carpet tiles, the light transmissive housings are preferably formed of molded plastic and the light emitting means are preferably light emitting diodes.

WO-2009/066224 describes a light emitting tufted carpet. The carpet comprises a primary backing layer, an optional secondary backing layer, an optional adhesive layer, a plurality of carpet integrated light emitting diodes arranged to generate carpet light, and a first electric conductor and a second electric conductor. The first electric conductor and the second electric conductor are arranged to provide power from a power source to the light emitting diodes. The primary backing layer comprises a first felt layer, or the optional secondary backing layer comprises a second felt layer, or both the primary backing layer and the optional secondary backing layer comprise felt layers. One or more of the first electric conductor and the second electric conductor are at least partially integrated in one or more of the first felt layer and the second felt layer.

SUMMARY OF THE INVENTION

The problem is related to the use of a hidden lighting unit behind a cover (such as wall paper or carpet), where the lighting unit is glued between the cover and the wall or floor. The problem is that the lighting unit cannot be removed or repaired once the cover layer has been glued, especially in general not without substantial damage to, or substantial removal of, the (entire) cover. Hence, after providing a stack of a support, such as a wall or a floor, and a support cover, such as wall paper or carpet, thereon, with on one or more positions one or more lighting units, repair or replacement of such lighting unit(s) is complicated or even hardly possible, without damage of the cover.

Hence, it is an aspect of the invention to provide an alternative stack arrangement of a support and a support cover (with one or more lighting units arranged in between), which preferably further at least partly obviates one or more of above-described drawbacks. It is further an aspect of the invention to provide an alternative lighting unit and/or support cover, which preferably further at least partly obviate one or more of above-described drawbacks when applied in such stack. It is further an aspect of the invention to provide an alternative method for accessing a lighting unit in such stack, for instance for repair or replacement. It is also an aspect of the invention to provide an alternative method for the production of such stack arrangement.

Stack

The solution proposed here is amongst others to provide a lighting unit with a release liner unit, such that the support cover may be locally cut open, and subsequently the support cover may be removed from the lighting unit using the release liner. This exposes the lighting unit such that it may for instance be repaired. If a release liner unit is also used on the bottom of the lighting unit, the lighting unit may also easily be removed and replaced. In a further embodiment, the lighting unit is provided with an extra large release liner unit specifically suited for cutting through the cover layer.

Hence, in a first aspect, the invention provides a stack arrangement (herein also indicated as "stack") comprising a support and a support cover ("cover"), adhesively bonded to the support. The support cover is preferably selected from the group consisting of wall paper, carpet, PVC flooring, linoleum flooring, and plaster. At a position between the support and the support cover a lighting unit is arranged, the lighting unit being configured to provide light through the support cover. The lighting unit is releasably bonded to at least one of the support and the support cover via a release liner unit comprising a release liner for releasable binding. In other words, (a) the lighting unit and the support cover are releasable bonded to each other via the release liner unit, or (b) the lighting unit and the support are releasable bonded to each other via the release liner unit, or (c) the lighting unit and the support cover are releasable bonded to each other via a (first) release liner unit and the lighting unit and the support are releasable bonded to each other via a (second) release liner unit. As will be clear to the person skilled in the art, when more than one release liner unit is applied (such as for instance in option (c)), especially each release liner unit comprises such release liner for releasable binding.

Such stack arrangement may allow hiding the lighting unit behind the cover, so that the lighting unit is (substantially) not visible by eye (when switched off). However, such stack may also allow opening of the support cover, such as wall paper or carpet, and access to the lighting unit.

In a specific embodiment, the support cover comprises wall paper. In yet another specific embodiment, the support cover comprises carpet. In yet a further specific embodiment, the support cover comprises PVC flooring. In another specific embodiment, the support cover comprises linoleum flooring. In yet another specific embodiment, the support cover comprises plaster.

The release liner unit in general consists of at least two parts. One part may be released from the other. The release is due to the fact that the liner (or "release liner"; herein sometimes also indicated as "first part"), may be released from another (second) part of the release liner unit. The liner and second part (also) form a stack; in general, the release liner unit will thus be a stack. Hence, this allows the releasability. As also indicated below, the phrase "releasable bonded to each other via (with) a release liner unit" and similar phrases indicate that the items are bonded to each other (via the release liner unit), but due to the presence of the release liner, the items are releasable bonded to each other. By detaching the release liner, the two items may be detached from each other, and thus released.

Herein, two main embodiments of the release liner unit are especially described. The release liner unit may be adhesive based or may be Velcro based, but is especially adhesive based (especially in order to allow a thin arrangement). See further also below on the release liner unit.

By decoupling of the lighting unit and the support cover, the support cover may be opened and the lighting unit can be accessed. Decoupling may be possible, since the lighting unit and support cover may in an embodiment be connected to each other via the release liner unit. Decoupling may also be possible, since the lighting unit and support may in an embodiment be attached to each other via the release liner unit. The release liner unit may allow a smooth decoupling, and thus a reuse of the part of the support cover that is opened to approach the lighting unit. Preferably, at least the lighting unit and the support cover are releasable bonded to each other with a release liner unit (herein this release liner unit is sometimes also indicated as "first release liner unit").

Hence, by releasing the release liner, items such as the lighting unit and support cover, and/or support and lighting unit, may be decoupled. Therefore, the bonding of those items is herein indicated as releasable bonding.

Herein, the term "stack arrangement" relates to the arrangement of a support cover on a support. The term "support" may in principle relate to any object that is used to cover with wall paper or carpet, or PVC flooring, or linoleum flooring (or plaster). The support will in general be a wall or a floor, although it might also be a ceiling. In a specific embodiment, the support is a wall and the support cover comprises wall paper or the support comprises a floor or a wall, and optionally an underlay, and the support cover comprises a carpet. As will be clear to a person skilled in the art, the invention may be applied at the same time in a space to one or more of a wall, floor and ceiling. The term "wall" may also include temporary walls, or other similar objects, like such as a partition.

The term "support cover" relates to a cover that can be used to cover a support, and may herein especially relate to a support cover selected from the group consisting of wall paper, carpet, PVC flooring, linoleum flooring or plaster, and optionally other materials. The term "carpet" especially relates to broadloom carpet. Herein, the support cover (when used as such) is attached to the support by means of an adhesive, such as glue or another sticking material. In an embodiment, the support cover and support are herein especially not attached to each other via a release liner unit, i.e. at places where the support cover and support form the stack, without lighting unit in between, the support cover and support are especially attached to each other with adhesive and not via a release liner unit. When plaster is used as cover, the plaster may be adhesive itself and stick to the support.

At one or more positions ("lighting unit positions") within the stack (i.e. between the support and support cover), one or more lighting units may be arranged. Hence, the stack arrangement of support and support cover may include one or more positions, wherein the stack arrangement comprises an arrangement of a support, a lighting unit and a support cover. The phrase "stack arrangement of support and support cover" may also include embodiments wherein between the support and support cover one or more intermediate layers may be arranged, such as for instance an underlay. Further, also adhesive is arranged between the support and support cover. The adhesive may especially be suitable as carpet adhesive, or wall paper adhesive, or PVC flooring adhesive, or linoleum flooring adhesive, dependent upon the type of application. Would an underlay be present, also adhesive may be arranged between the support and the underlay and/or between the underlay and the support cover.

Note that the presence of adhesive does not necessarily include that all contact surface between two items that are adhered to each other must be adhered together with adhesive; adhesive may also be applied in a patterned way (regular or irregular).

Likewise, the presence of the release liner unit does not necessarily include that all contact surface between the lighting unit and support cover (and/or where applicable between the support (including optional underlay) and lighting unit) is connected via the release liner unit. In contrast, in an embodiment part of the front face of the lighting unit, i.e. the face from which light of the lighting unit travels away, may not be covered by the release liner unit in order not to intercept the light of the lighting unit. The specific configuration may for instance depend upon the transmissive properties of the release liner unit (see also below).

In a specific embodiment, the release liner unit extends beyond an edge of the lighting unit. Hence, at least part of the front face (and/or back face) may be covered by the release liner unit(s), but the release liner unit(s) extend(s) further than an edge of the lighting unit. Thus, the length and/or width of the lighting unit (system) without release liner unit(s) is smaller than with release liner unit(s). This may allow an easier removal of the lighting unit since the support cover may be opened at some distance of the lighting unit (this may be less critical than opening of the cover substantially precisely over the lighting unit). Especially when for instance a connector, such as seam tape, is to be used when rearranging the support cover in its original position, a cut in the support cover at some distance of the lighting unit may make rearrangement with such connector easier. Hence, especially advantageous is the embodiment wherein at least the support cover and lighting unit are releasable bonded with a release liner unit, wherein preferably the release liner unit extends beyond the edge of the lighting unit, preferably beyond the entire edge of the lighting unit.

Support Cover

In yet a further aspect, the invention provides a support cover, preferably selected from the group consisting of wall paper, carpet, PVC flooring, linoleum flooring, and plaster.

The support cover is preferably selected from the group consisting of a wall paper, a carpet, a plaster layer, a linoleum flooring and a PVC flooring, especially selected from the group consisting of a wall paper, a carpet, and a PVC flooring, and more especially selected from the group consisting of a wall paper and a carpet.

The support cover preferably has a light transmission in the range of 0.5-30%, especially in the range of 1-20%, for light having a wavelength selected from the visible wavelength range. The support cover, when applied, comprises a cover front face and an opposite cover support face (i.e. the part of the cover facing the support). Further, also when the support cover is selected from the group consisting of a wall paper, a carpet, a linoleum flooring and a PVC flooring, the support cover comprises a cover front face and an opposite cover support face.

In a specific embodiment, the support cover further comprises a lighting unit. Hence, the invention further provides in a further aspect a support cover selected from the group consisting of wall paper, carpet, PVC flooring and linoleum flooring, having a light transmission in the range of 0.5-30%, especially in the range of 1-20%, for light having a wavelength selected from the visible wavelength range, wherein the support cover comprises a cover front face and an opposite cover support face, having a cover support face area, and wherein to at least part of the cover support face a release liner unit is attached, the release liner unit having a release liner unit area which is preferably smaller than the cover support face area, wherein the release liner unit comprise a release liner for releasable binding. Such support cover may be used as support cover to cover a support, and to arrange at one or more positions a lighting unit between the support and support cover.

The support cover and lighting unit may releasable be attached to each other via the (first) release liner unit. When providing the stack arrangement, optionally the support and lighting unit may also releasable be attached to each other via the (second) release liner unit; see also below).

As mentioned above, the support cover is especially a wall paper or a carpet, but may also include other support covers such as linoleum flooring, PVC flooring and plaster. When using a carpet, the carpet is especially a tufted carpet, such as described in for instance WO-2010/052606. Hence, in a specific embodiment the support cover is a tufted carpet. Such tufted carpet may comprise a primary backing and optionally also a secondary backing. The primary backing and secondary backing may be adhered to each other.

Especially, the support cover has a light transmission in the range of 0.5-30%, especially in the range of 1-20%, for light generated by the lighting unit and having a wavelength selected from the visible wavelength range. In this way, the support cover is transmissive for visible light from the lighting unit. However, the lighting unit may not be visible from the outside, i.e. from the side of the support cover (a user will in general see the cover front face). Hence, a user of the stack arrangement, such as a person residing in a space comprising such stack arrangement, such as a wall with wall paper and/or a floor with carpet, may not perceive the lighting unit behind the support cover, and may only notice the presence of the lighting unit, when the lighting unit is switched on and provides its lighting unit light. Herein, the term "visible light" especially relates to light having a wavelength selected from the range of 380-780 nm.

Hence, the indicated transmission range may on the one hand provide enough transmission through the support cover, for instance to make the light effect even visible under typical office lighting conditions, especially assuming state of the art LEDs, preferably solid state LEDs, but on the other hand, may substantially prevent visibility of elements (such as for example the light source) behind the support cover. Visibility of the support, lighting unit(s) or other elements under the support cover may especially not be desired, because the lighting unit(s) (or other elements, like electric wires, reflective foil, a padding) may no longer be hidden. The principle presented here may also be indicated as "hide light": the lighting unit may be hidden and not visible to a user of the support cover, while the light generated thereby is visible to the user.

The transmission or light permeability can be determined by providing light at a specific wavelength with a first intensity to the material and relating the intensity of the light at that wavelength measured after transmission through the material, to the first intensity of the light provided at that specific wavelength to the material (see also E-208 and E-406 of the CRC Handbook of Chemistry and Physics, 69$^{th}$ edition, 1088-1989).

Transmission is measured of light travelling through the support cover from the back side (herein also indicated as cover support face) to the user side (herein indicated as cover front face). The back side is the part of the support cover that is in general arranged on the support. The user side is the front side, and is the side that is visible to a user when the support cover is arranged as support cover on the support. The intensity of the light downstream of the top face or user side is related to the intensity of the light upstream of the support cover, i.e. at the back side. The light shed on the back side for determining transmission is preferably directed on the back side under normal incidence and the total integrated light emission on the other side of the support cover is measured.

In a specific embodiment, the release liner unit is a bonded to the support cover on site, i.e. the support cover is provided/produced without release liner unit and before creating the stack arrangement on site, the release liner unit is bonded to the support cover. Subsequently, the support cover is applied to the support and lighting unit and the lighting unit is bonded to the release liner unit. In this way, the lighting unit and support cover and/or lighting unit and support are bonded to each other with the release liner unit.

Lighting Unit System

In a further aspect, the invention provides a lighting unit system comprising a lighting unit with a front face and a back face, wherein the lighting unit is configured to provide light travelling in a direction away from the front face, and wherein a release liner unit is attached to (preferably) the front face (of the lighting unit). Such lighting unit system may be applied in the stack arrangement as defined herein. As mentioned above, the release liner unit comprises a release liner for releasable binding (of the lighting unit to the support cover (and/or to the support; see also below)).

In a specific embodiment, the lighting unit system comprises a further release liner unit attached to the back face of the lighting unit. Especially embodiments wherein at locations a stack is provided of a support, lighting unit, and support cover, wherein the support and lighting unit are bonded to each other with a release liner unit, and wherein the lighting unit and support cover are bonded to each other with a release liner unit, may allow an easy access to the lighting unit, when (partly) removing the support cover and may allow an easy removal or repair of the (complete) lighting unit. Also here, the release liner unit comprises a release liner for releasable binding (of the lighting unit to the support).

As mentioned above, in a preferred embodiment, the release liner unit extends over an edge of the lighting unit. When a release liner unit is applied to the front face and a release liner unit is applied to the back face of the lighting unit, this may apply to both the release liner units (i.e. both extend over and edge), but may also apply to only one of the release liner unit. Preferably, the release liner unit on the top face extends over an edge.

In a specific embodiment, the lighting unit has a thickness (not including the release liner unit(s)) in the range of 0.5-15 mm, especially in the range of 0.5-1.5 mm, and the lighting unit preferably comprises a plurality light sources, such as a plurality of LEDs. The term "a lighting unit system" may in an embodiment also relate to a plurality of lighting unit systems.

The lighting unit in general comprises a plurality of light sources, especially LED (light emitting diode) light sources. The term "plurality of light sources" may refer to 2 or more light sources (especially LEDs), especially 2-100,000, for instance 2-10,000, like 4-300, such as 16-256. Hence, the lighting unit may comprise a plurality of LEDs. In general, the stack may comprise 2-10,000 LEDs/$m^2$, especially 25-2,500 LEDs/$m^2$.

Note that the plurality of LEDs may be distributed over a plurality of lighting units. Thus, a stack may comprise one or more lighting units. In general, the stack will comprise a plurality of lighting units, depending upon the area to which the support cover is applied. The lighting units may be adjacent, or may be arranged at non-zero distances from each other; the latter is preferred. The lighting units may be powered independently or dependently. The lighting units may for instance be electrically interconnected. A controller (see below), may control one or more lighting units individually. The controller may (also) control one or more lighting units (or even light sources) individually.

The light source(s) may comprise any light source(s), such as a small incandescent lamp or a fiber tip or fiber irregularity (arranged to let light escape from the fiber, which embodiment has the advantage that it is relatively cheap), but may especially comprise a LED (light emitting diode) (as light source). A specific advantage of using LEDs is that they are relatively small and may thereby fit better in a recess in a substrate (see also below). As mentioned before, a total thickness of the lighting unit below 1 mm is preferred, and this may only be achieved with LEDs. The term LED may refer to OLEDs, but especially refers to solid state lighting. Unless indicated otherwise, the term LED herein further refers to solid state LEDs. Especially, the light source is part of a lighting unit comprising a plurality of light sources.

Solid state LEDs as light source(s) is especially desired because of their small dimensions. Such light sources with state of the art technique may be less than 1 mm thick, even in the range of about 0.2 mm (excluding a support structure of 0.5-1 mm thickness, such as PCB (printed circuit board), or smaller.

When arranging such light source (for example having a total thickness of 1 mm including support structure) on a floor, the support cover may be arranged over the light source without substantial influence of the (presence of the) lighting unit on the (local) surface height of the support cover.

Alternatively or additionally, a lighting unit comprising a substrate with one or more light sources, may also comprise at its top face one or more cavities or recesses for hosting the one or more light sources. The one or more light sources may be partly or completely recessed in the one or more cavities/recesses, respectively. When the one or more light sources and/or other electrical components are hosted in one or more recesses, a substantially flat lighting unit may be achieved.

Hence, in an embodiment, the invention also provides a lighting unit that preferably comprises a PCB (Printed Circuit Board) with one or more recesses, especially for hosting one or more light sources. The one or more recesses may be arranged to host one or more light sources and/or one or more other electrical components, such as electrical connections, resistors, transistors, power source(s), controller(s), etc.

The lighting unit may optionally also comprise a leveling layer, which may be used to at least partially embed the light sources and/or which may be used to create a substantially flat top face (herein also indicated as "front face" or "lighting unit front face"). In an embodiment, the light sources may at least partially be embedded in the leveling layer. The leveling layer may be transmissive, especially in embodiments wherein the leveling layer is arranged over the light source(s) of the lighting unit. When a leveling layer is applied, a release liner unit may be attached to such leveling layer.

In a specific embodiment, the release liner unit is a bonded to the lighting unit on site, i.e. the lighting unit is provided/produced without release liner unit and before creating the stack arrangement, the release liner unit is bonded to the lighting unit. Subsequently, the support cover is applied to the support and lighting unit (with release liner unit(s)). In this way, the lighting unit and support cover and/or lighting unit and support may releasable be bonded to each other with the release liner unit(s).

Release Liner Unit

The release liner unit in general consists of at least two parts. One part may be released from the other. The release is due to the fact that the liner (or "release liner" or "first part"), may be released from another part of the release liner unit. Hence, this allows the releasability. Herein, two main embodiments of the release liner unit are especially described. The release liner unit may be adhesive based or may be Velcro based, but is especially adhesive based (especially in order to allow a thin arrangement). Irrespective of the basis of the release liner unit, the connection, if applicable, between support and (second) release liner unit, between (second) release liner unit and lighting unit, between lighting unit and (first) release liner unit, and between (first) release liner unit and cover are in general adhesive based. Hence, the release liner unit is located at a location where two items are attached together (via the release liner unit), but since it comprises a release liner, it also allows release of the two items from each other.

For example, the release liner unit is located between the lighting unit and a carpet (support cover), and the release liner unit is attached to the carpet (support cover) with carpet adhesive at the same time when the floor (support) is adhered to the carpet (support cover). The release liner unit is thus especially adhesively bonded to the items between which it is sandwiched, but allows release of the two items of each other, due to the fact that the release liner unit comprises a release liner.

Specific embodiments are described below and in the detailed description.

Velcro Based Release Liner Unit

Assuming a Velcro based release liner unit, the release liner unit consists of at least two parts, which are releasable connected to each other. The first part may be the hook part and the second part may be the loop part. Attached together they form an embodiment of the release liner unit. Here, in fact both parts may be considered release liners depending on how this release liner unit is used in an application, since both parts may be released from each other.

The release liner unit, or more precisely, the first part or the second part thereof, may be attached (by an adhesive) to (1) the support cover (cover support face), to (2) the front face of the lighting unit, to (3) the back face of the lighting unit, or to (4) the support. To create the stack, the other part of the release liner unit may be attached (by an adhesive) to (1) the front face of the lighting unit, to (2) the support cover (cover support face), to (3) the support, or to (4) the back face of the lighting unit, respectively. Hence, in these embodiments the entire release liner unit is first attached to an item of the stack, and then attached to an opposite item of the stack.

Alternatively or additionally, one part (the first or the second part) of the release liner unit may be attached (by and adhesive) to (1) the to the support cover (cover support face), to (2) the front face of the lighting unit, to (3) the back face of the lighting unit, or to (4) the support, and the other part (the second part or the first part) of the release liner unit may be attached (by an adhesive) to (1) the front face of the lighting unit, to (2) the support cover (cover support face), to (3) the support, or to (4) the back face of the lighting unit, respectively. Hence, in these embodiments the first or the second part of the release liner unit is first attached to an item of the stack, and the second or first part is attached to a (later) opposite item of the stack. The two stack items are arranged adjacent, and the two parts (loop and hook parts) are releasable connected/attached.

The advantage of this approach is that the two parts can be adhered together in the same way as the support cover is adhered to the support (for example carpet glue in the case of carpeting, or wallpaper glue in the case of wallpaper), while still resulting in a releasable connected/attached stack.

As will be clear to the person skilled in the art, two or more options may be applied at the same time.

Adhesive Based Release Liner Unit

Assuming an adhesive based release liner unit, the release liner unit consists of at least two parts (layers). The first part (layer) may be the liner (or herein also indicated as "release liner") and the second part (layer) may be the release liner adhesive (layer), to which the release liner releasable adheres. Attached together they form an embodiment of the release liner unit; the release liner (first part) can be released from the adhesive layer (second part).

The release liner unit, or more precisely, the first part (liner), may be attached (by an adhesive) to (1) the support cover (cover support face), to (2) the front face of the lighting unit, to (3) the back face of the lighting unit, or to (4) the support. To create the stack, the release liner adhesive may be applied to (1) the front face of the lighting unit, to (2) the support cover (cover support face), to (3) the support, or to (4) the back face of the lighting unit, respectively. Hence, in these embodiments the entire release liner unit is first attached to an item of the stack, and then attached to an opposite item of the stack.

Alternatively or additionally, the release liner unit, or more precisely, the second part, i.e. the release liner adhesive, may be may be arranged on (1) the support cover (cover support face), on (2) the front face of the lighting unit, on (3) the back face of the lighting unit, or on (4) the support. To create the stack, the other part of the release liner unit, the liner (here first part), may be attached (by an adhesive) to (1) the front face of the lighting unit, to (2) the support cover (cover support face), to (3) the support, or to (4) the back face of the lighting unit, respectively. Hence, in these embodiments the first or the second part of the release liner unit is first attached to an item of the stack, and the second or first part is attached to a (later) opposite item of the stack. The two stack items are arranged adjacent, and the two parts (release liner and adhesive layer) are releasable connected/attached.

In yet another embodiment, the release liner unit consists of at least three parts (layers): a first part (layer) may be the liner, an intermediate part (layer) may be the release liner adhesive (intermediate part or layer), and a second part (layer) may be a substrate (layer). The release liner releasable adheres (with the release liner adhesive) to the substrate. Attached together they form an embodiment of the release liner unit. In fact, it can be seen as a conventional sticker, which is with one side attached to one item (such as the lighting unit) and which is with the other side attached to the other item (such as the support cover). In this way, the two items are attached to each other, but in a releasable way, since the two parts of the sticker can be released.

The release liner unit, or more precisely, the first part, the release liner, may be attached (by an adhesive) to (1) the support cover (cover support face), to (2) the front face of the lighting unit, to (3) the back face of the lighting unit, or to (4) the support. To create the stack, the substrate may be attached (by an adhesive) to (1) the front face of the lighting unit, to (2) the support cover (cover support face), to (3) the support, or to (4) the back face of the lighting unit, respectively. Hence, in these embodiments the entire release liner unit is first attached to an item of the stack, and then attached to an opposite item of the stack.

Alternatively or additionally, this may be arranged the other way around, i.e. the release liner unit, or more precisely, the second part, i.e. the substrate, may be attached (by an adhesive) to (1) the support cover (cover support face), to (2) the front face of the lighting unit, to (3) the back face of the lighting unit, or to (4) the support. To create the stack, the other part of the release liner unit, the liner, may be attached (by an adhesive) to (1) the front face of the lighting unit, to (2) the support cover (cover support face), to (3) the support, or to (4) the back face of the lighting unit, respectively. Hence, in these embodiments the first or the second part of the release liner unit is first attached to an item of the stack, and the second or first part is attached to a (later) opposite item of the stack. Subsequently, the two stack items are arranged adjacent, and the two parts are releasable connected/attached.

As will be clear to the person skilled in the art, two or more options may be applied at the same time.

Release Liner Unit General

The release liner unit, especially when adhesive based, may be transmissive for light, and may, if desired, cover substantially the entire front face of the lighting unit and/or the entire back face of the lighting unit.

Optionally, the release liner unit may be patterned, for instance with one or more openings, such as for light generated by the lighting unit. When Velcro based, the release liner unit is preferably patterned, for instance with one or more openings, such as for light generated by the lighting unit.

Method for the Production

In a further aspect, the invention provides a method for the production of a stack arrangement as defined herein, comprising providing a support, a lighting unit, a support cover, and a release liner unit (or a plurality of release liner units), arranging the lighting unit at a position on the support and forming a stack arrangement of the support and support cover by adhesively binding the support and support cover to each other and by (a) releasable binding the support and the lighting unit with a release liner unit, or (b) releasable binding the lighting unit and the support cover with a release liner unit, or (c) releasable binding the support and the lighting unit with a release liner unit and releasable binding the lighting unit and the support cover with a (second) release liner unit.

Method of Approaching (Accessing) the Lighting Unit in the Stack

The invention also provides in an aspect a method of approaching a support cover hidden lighting unit in a stack arrangement as defined herein (see for instance above), comprising:

a. creating an incision in the support cover over a lighting unit;

b. releasing the release liner unit and detaching the support cover from the lighting unit; and c. accessing to the lighting unit.

Note that the incision is not necessarily a lighting unit circumferential incision. Choosing the appropriate position and length of the incision(s), a flap of the support cover may be released from the lighting unit, by which the lighting unit can be approached, and if desired also removed.

Hence, the invention also provides such method further comprising:

d. optionally removing the lighting unit from its lighting unit position, arranging the same (for instance after repair) or another lighting unit to the lighting unit position and optionally binding (optionally via a release liner unit) the support and lighting unit;

f. bonding the support cover and the lighting unit together (optionally via a release liner unit) and connecting parts of the support cover that were separated by the incision.

Such method and stack arrangement may especially of interest for plaster support covers. Such support cover cannot be removed without damage and also cannot easily be replaced. With the present invention, the plaster layer is detached by releasing the release liner and the lighting unit can be accessed, for instance for repair or replacement.

Others

The stack arrangement, or lighting unit, or support cover may further comprise a controller, which may be arranged external but which may also be integrated in the stack arrangement, or lighting unit (system), or support cover, respectively, arranged to control the lighting unit, and especially the individual light sources of the lighting unit. In embodiments wherein the stack arrangement comprises a plurality of lighting units, the total system may comprise one or more controllers. In general, there will be one central controller, herein further indicated as "controller". For larger (floor) areas, optionally a plurality of independent or dependent controllers may be used. Hence, in an embodiment, the stack arrangement, or lighting unit, or support cover, respectively, further comprise a controller arranged to control the lighting unit; i.e. the controller is arranged to control the light generated by the lighting unit. In this way, also for instance information may be provided, like arrows indicating in a specific direction, or commercial information. One or more of color, on/off state, intensity, pattern shape and information content of the light may be variable and may be controlled by the controller. A controller may be integrated in the lighting units. For example, by having a controller on each board (or lighting unit), the different boards may communicate with each other, for instance to determine the on/off states, etc.

Terms like "below", "above", "top", and "bottom" relate to positions or arrangements of items which would be obtained when for instance the support cover is arranged substantially flat on a substantially horizontal surface with the user side and back side of the support cover and/or top side and bottom side of the lighting unit substantially parallel to the substantially horizontal surface. However, this does not exclude the use of the support cover in other arrangements, such as against a wall, or in other (vertical) arrangements.

The terms "upstream" and "downstream" relate to an arrangement of items or features relative to the propagation of the light from a light generating means (here the lighting unit, especially the light source, such as the LED), wherein relative to a first position within a beam of light from the light generating means, a second position in the beam of light closer to the light generating means is "upstream", and a third position within the beam of light further away from the light generating means is "downstream".

The support and support cover with lighting unit may be used in all kind of applications. The lighting may be used as general lighting and/or to create special effects. Further, the lighting can be used for emergency exit indication or way finding, or can be used in general path finding.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1:
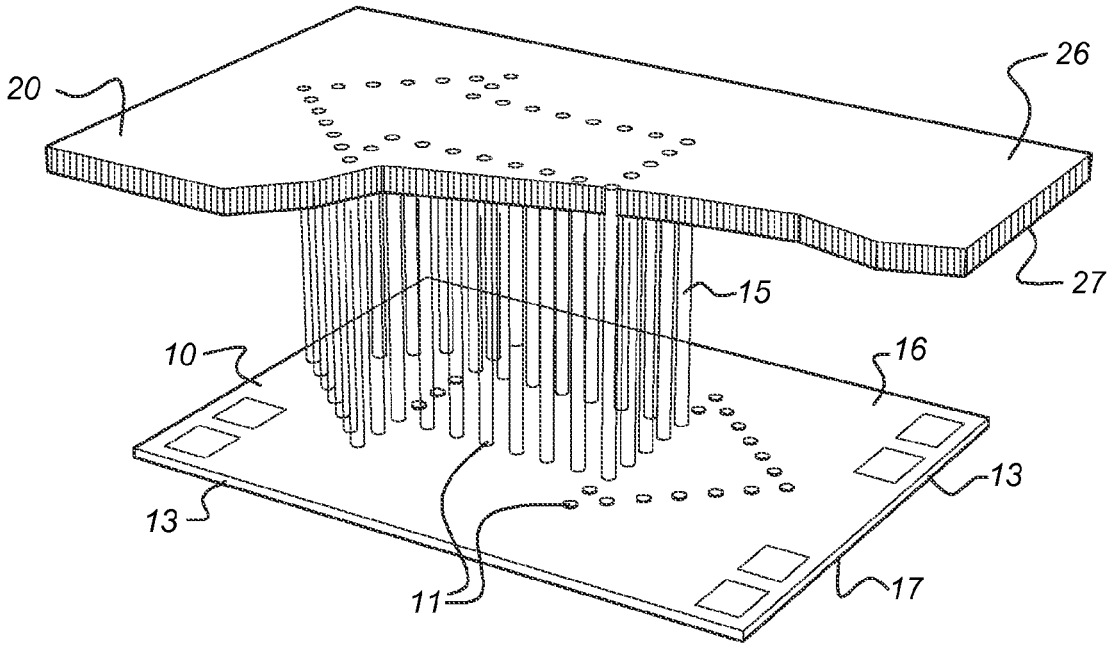
FIG. 1 schematically depicts an embodiment of a combination of a support cover and a lighting unit.

FIG. 1 schematically depicts a combination of a support cover 20, especially a carpet, having a cover front face 26 and an opposite cover support face 27. Further, FIG. 1 schematically depicts a lighting unit 10 having a plurality of light sources 11. The lighting unit 10 has a front face 16 and a back face 17. Further the lighting unit 10 has an edge 13. The light sources 11 are arranged to provide light 15. This light 15 is transmitted through the support cover 20. This light penetrates from the cover support face 27 to the cover front face 26 to the exterior. For clarity reasons, the cover 20 is drawn at a distance from the lighting unit 10. Relative to the lighting unit 10, the support cover 20 is arranged downstream of the lighting unit 10. Light 15 thus travels away from the cover front face 26 (further downstream of the lighting unit 10 and support cover 20, respectively).

Figure 2A:
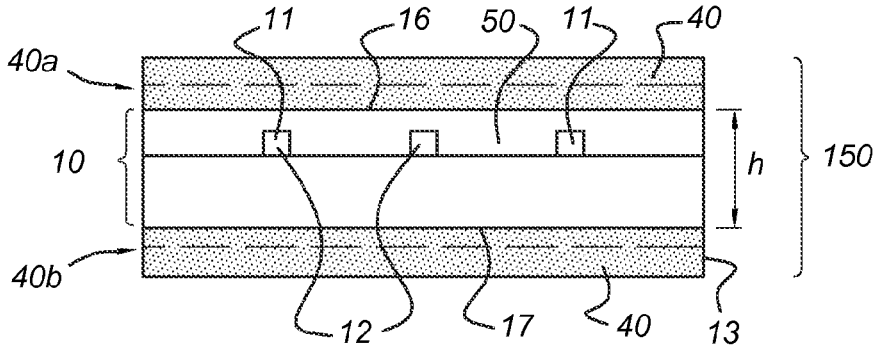
FIGS. 2*a*-2*d* schematically depicts embodiments of the lighting unit and stack arrangement.

FIG. 2*a* schematically depicts a lighting unit 10 with release liner 40. The combination of a lighting unit 10 and at least one release liner 40 attached to the front face 16 or back face 17 of the lighting unit is herein indicated as lighting unit system 150. Actually in the embodiment schematically depicted in FIG. 2*a*, the lighting unit system 150 comprises two release liner units 40, a first one indicated with ref 40*a*, and the second one indicated with ref. 40*b*. The first release liner unit 40*a* is arranged on front face 16; the second release liner unit 40*b* is arranged on back face 17 from the lighting unit 10. However, the lighting unit system 150 may also comprise a lighting unit 10 with one or more release liners 40 only arranged at one of the front face 16 and back face 17.

The lighting unit 10 comprises, by way of example, a plurality of light sources 11. The light sources 11 may for instance be LEDs. The LEDs are indicated with reference 12. For instance the light sources 11 may be provided on a substrate. The substrate with light sources 11 may be non-planar. Therefore a leveling layer 50 may be provided, which may provide a substantially planar front face 16. The first release liner unit 40 may be transparent (i.e. comprise transparent material) in order to allow light from the light sources 11 escape to the cover 20 (and through the cover 20); alternatively or additionally, the first release liner unit 40*a* may be arranged in such a way that it does not intercept the light from the light sources 11, for instance by having openings or by applying in a patterned way the first release liner unit 40*a*. The lighting unit 10 has a height or thickness h, which is preferably in the range of 0.5-1.5 mm. Reference 150 (lighting unit system) thus indicates the combination of lighting unit 10 and one or more release liner units 40, which may be applied to the front face 16 and/or the back face 17.

Figure 2B:
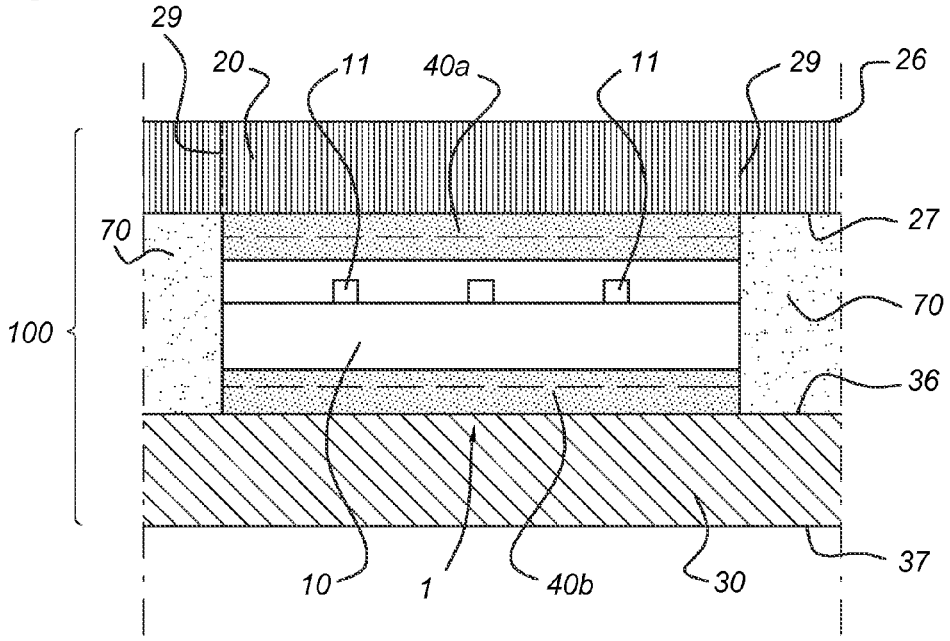

FIG. 2*b* schematically depicts a stack arrangement 100, which comprises a support cover 20 and a support 30. The support cover 20 and support 30 are attached to each other with an adhesive 70. At a location 1, lighting unit 10 may be provided, which is arranged between the support cover 20 and the support 30. Hence, at this location 1 the stack arrangement 100 comprises a stack of support cover 20, lighting unit 10 and support 30. Even though this Fig. and the next do not show this, typically adhesive (such as adhesive 70) will also be present between the release liner unit 40*a* and the support cover 20, and/or between the release liner unit 40*b* and the support 30.

In the schematically depicted embodiment of FIG. 2*b*, two release liner units 40 are applied. A first release liner unit 40*a* between the support cover 20 and the lighting unit 10, and a second release liner unit 40*b* between the lighting unit 10 and the support 30. The support 30 has a support front face 36 (and a support back face 37). For instance, the support 30 may be a wall and support front face 36 is the surface of such wall. Alternatively the support 30 may be a floor, and the support front face 36 is the surface of the floor. Light 15 (not shown), generated by the lighting unit(s) 11, will travel away from the front face, permeate through the support cover 20 (from the cover support face 27 to the cover front face 26 to the exterior).

Figure 2C:
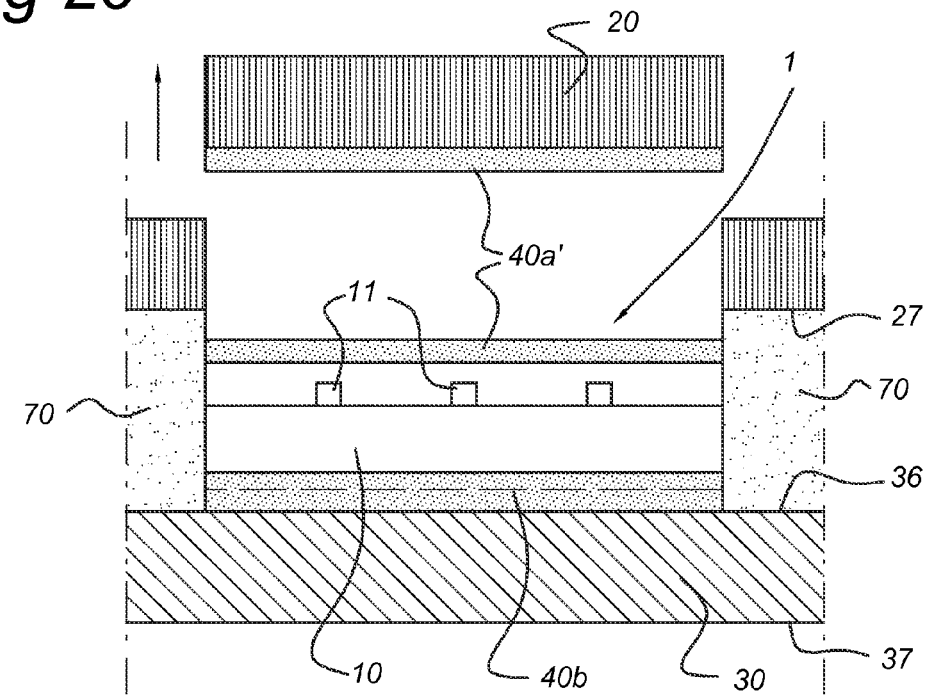
Figure 2D:
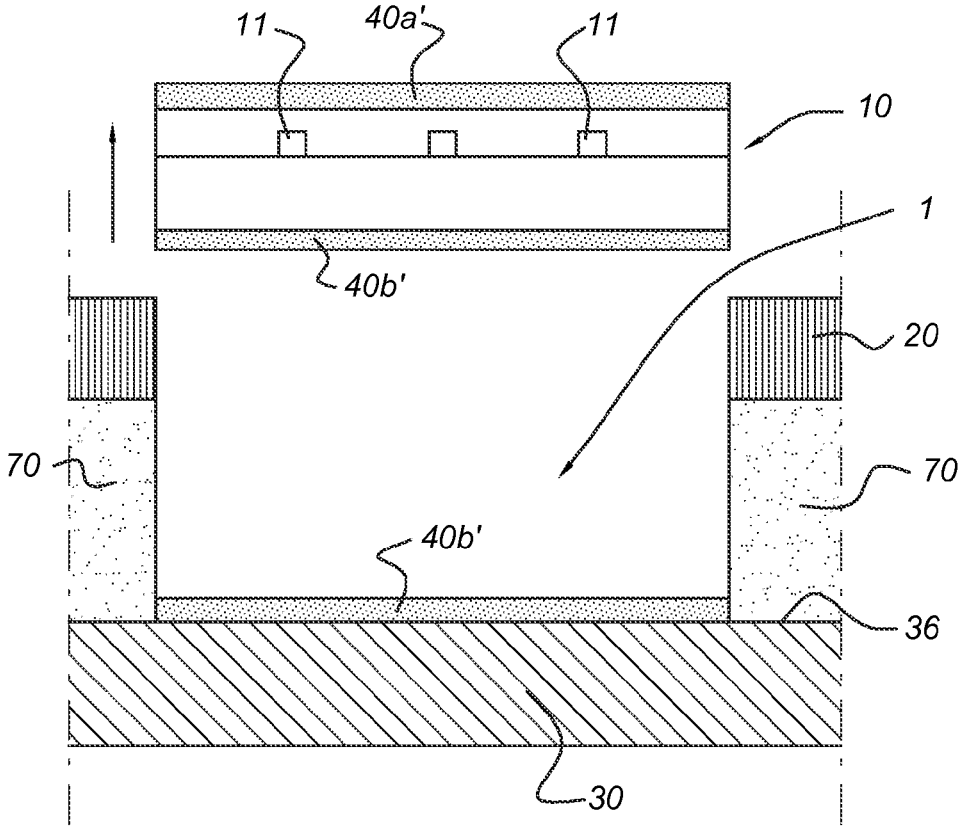

FIG. 2*b* also schematically depicts how the lighting unit 10 can be approached. For instance incisions 29 may be provided into the support cover 20 which provide cuts in the support cover 20 from the cover front face 26 to the cover support face 27. Then at least part of the support cover 20 may be lifted since the release liner unit 40*a* allows a release (indicated with separated parts 40*a*', indicating the release of the liner of the release liner unit 40*a*). One of those parts 40*a*' is the release liner. This is schematically depicted in FIG. 2*c*. Here the liner is released from the adhesive, and so access may be obtained to the lighting unit 10. FIG. 2*d* then schematically depicts an embodiment how the complete lighting unit 10 may be retrieved from its position 1 since in this embodiment the lighting unit 10 is also releasable from the support 30, since the lighting unit 10 and the support 30 are connected to each other through the second release liner unit 40*b* (references 40*b*' similarly indicate the release of the liner from the release liner unit 40*b*). One of those parts 40*b*' is the release liner. For instance after repairing or exchange of the lighting unit 10 and optionally providing new release liner units 40, the repaired lighting unit 10 or exchanged lighting unit 10 may be arranged again at position 1 and the support cover 20 may be arranged at its original position. Thereby the integrity of the entire support cover 20 may substantially be remained.

Note that in FIGS. 2*b*-2*d* for the sake of understanding, no adhesive is shown between support front face 36 and the second release liner unit 40*b* and/or no adhesive is shown between cover support face 27 and the first release liner unit 40*a*. In general, adhesive will however be present, see also FIGS. 5*a*-5*l*. This may be the same adhesive as adhesive 70.

Figure 3A:
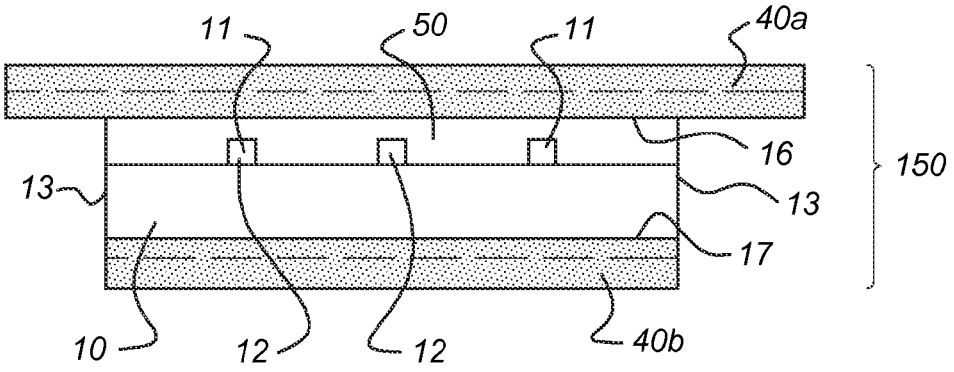
FIGS. 3*a*-3*d* schematically depict some other embodiments of the lighting unit and stack arrangement.
Figure 3B:
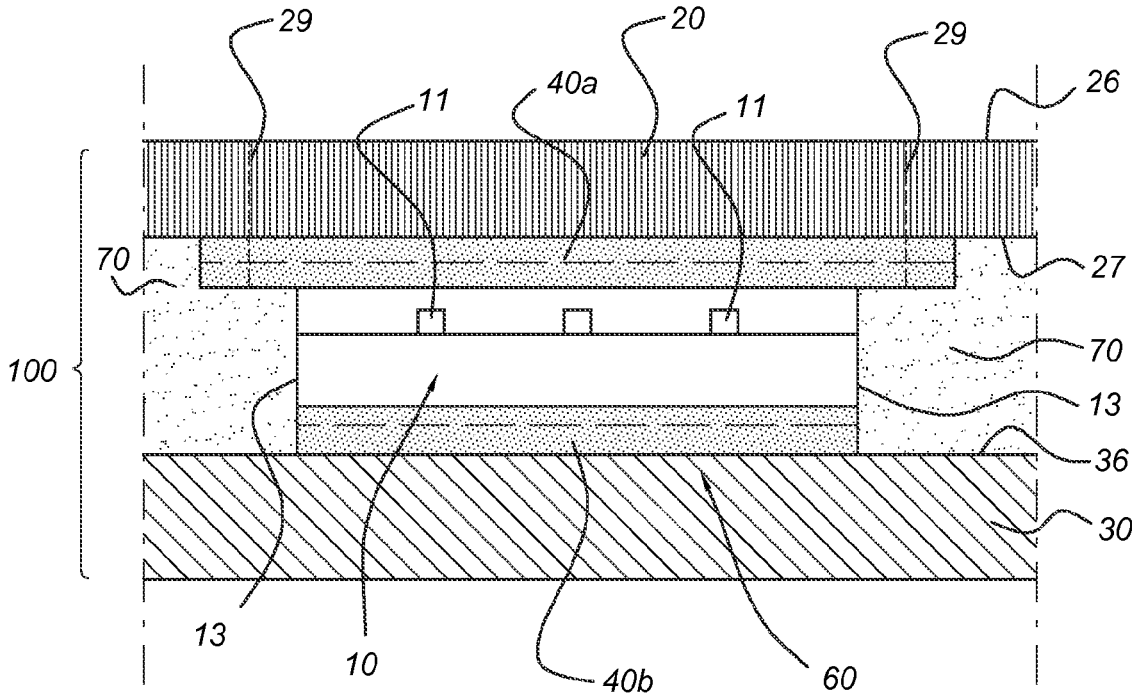

FIG. 3*a* schematically depicts an embodiment wherein one of the release liner units 40, here the first release liner unit 40*a*, extends over an edge 13 of the lighting unit 10. This may have advantages over the above described embodiments. This is explained in the following FIG. 3*b* schematically depicts the same lighting unit as schematically depicted in FIG. 3*a* but now integrated in the stack 100. The stack arrangement 100 is provided of support 30 and support cover 20 with at a position 1 the lighting unit 10 arranged between the support cover 20 and support 30. In this embodiment, the lighting unit 10 is provided with first release line unit 40*a* extending over an edge 13 of the lighting unit 10 and second release line unit 40*b*. Again incision 29 may be provided, but now the position of the incision 29, or incisions 29, is less critical, because the release liner unit 40 (here only the first release liner unit 40*a*) extends beyond the edge 13 of the lighting unit 10. The support cover 20 over lighting unit 1 may be opened, as also described above, and the lighting unit 10 may be approached. For instance the lighting unit 10 may be repaired of replaced and the release 10 may be replaced.

Figure 3C:
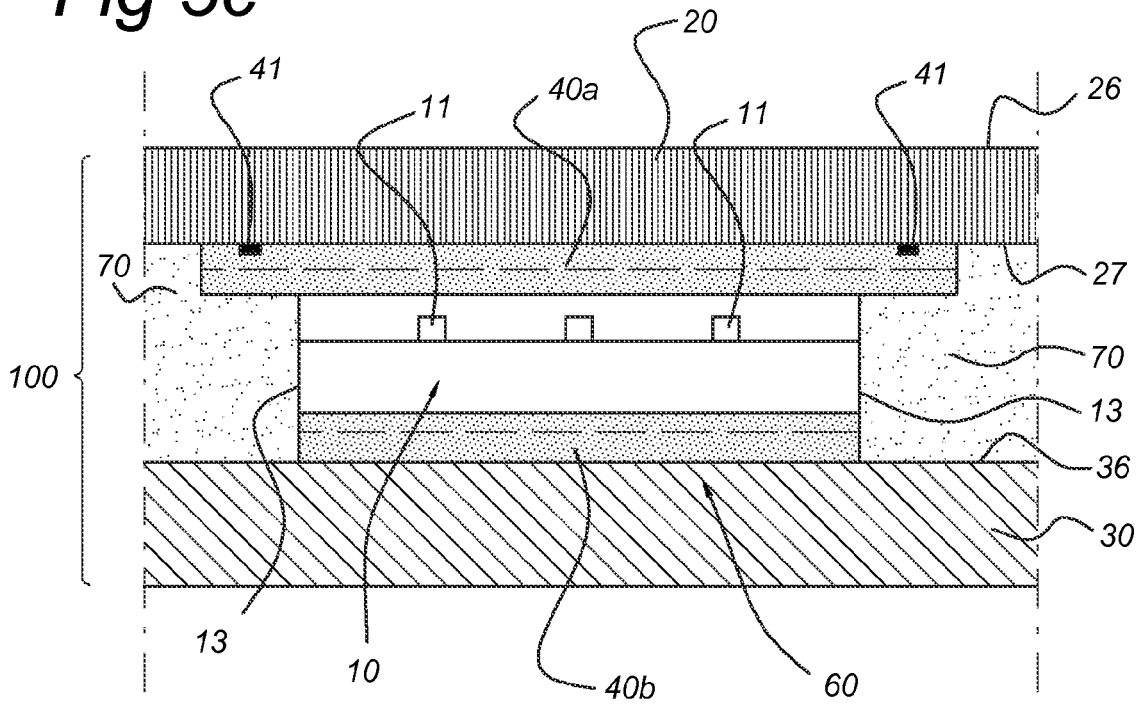

Hence, a minor problem that may be associated with the embodiments depicted in FIGS. 2*a*-2*d* may be that the cover 20 cannot easily be placed back. For example, in the case of carpet, typically a seam tape is used to bond two parts of carpet together. This tape typically comprises a wax that is heated, after which the two sides of the carpet are bonded together. The seam tape is preferably arranged to adhere both sides of the cut/incision 29 that was made through the carpet. Therefore, it is an advantage if the lighting unit 10 has an additional edge of release liner unit, such that the cover 20 may be released also beyond the lighting unit 10 (as schematically depicted in FIGS. 3*a*-3*c*). An additional advantage of this approach is that the exact location of the incision 29 through the cover 20 is less sensitive, because the cover 20 can be released over a larger area. FIG. 3*c* schematically depicts the stack arrangement 100 after closing again the cover 20 over the lighting unit at position 1. Reference 41 indicates a connector, such as tape or a seam, connecting the support cover parts that were separated by incision 29.

Figure 3D:
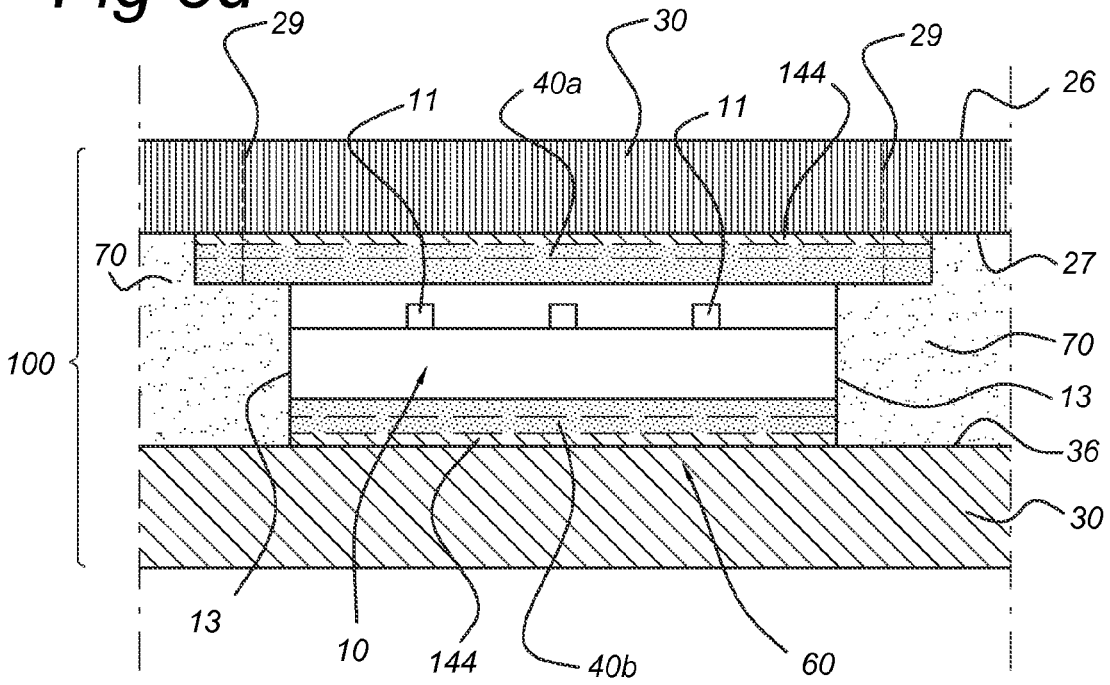

Note that in FIGS. 3*b*-3*c* for the sake of understanding, no adhesive is shown between support front face 36 and the second release liner unit 40*b* and/or no adhesive is shown between cover support face 27 and the first release liner unit 40*a*. In general, adhesive will however be present, see also FIGS. 5*a*-5*l*. This may be the same adhesive as adhesive 70. Hence, for clarity reasons, the embodiment of FIG. 3*b* is schematically depicted in FIG. 3*d*, including options how the connection with the support cover 20 and support 30 may be arranged. As mentioned above, adhesive layers 144 may comprise the same adhesive as applied between the support 30 and support cover 20 (i.e. adhesive 70).

Figure 4A:
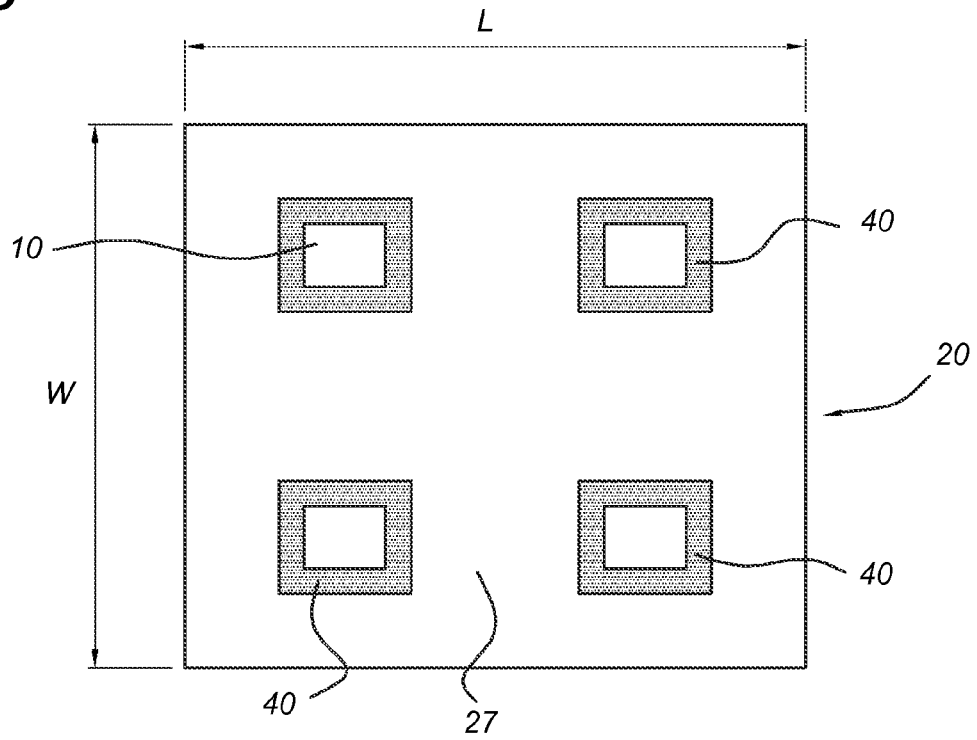
FIGS. 4*a*-4*c* schematically depict some top view embodiments of the stack arrangement.

FIG. 4*a* schematically depicts an embodiment of the support cover 20, seen from below, i.e. observing the cover support face 27, wherein the support cover 20 further comprises one or more release liner units 40. The area of the cover support face 27 can in this embodiment be calculates as length*width (L*W).

Figure 4B:
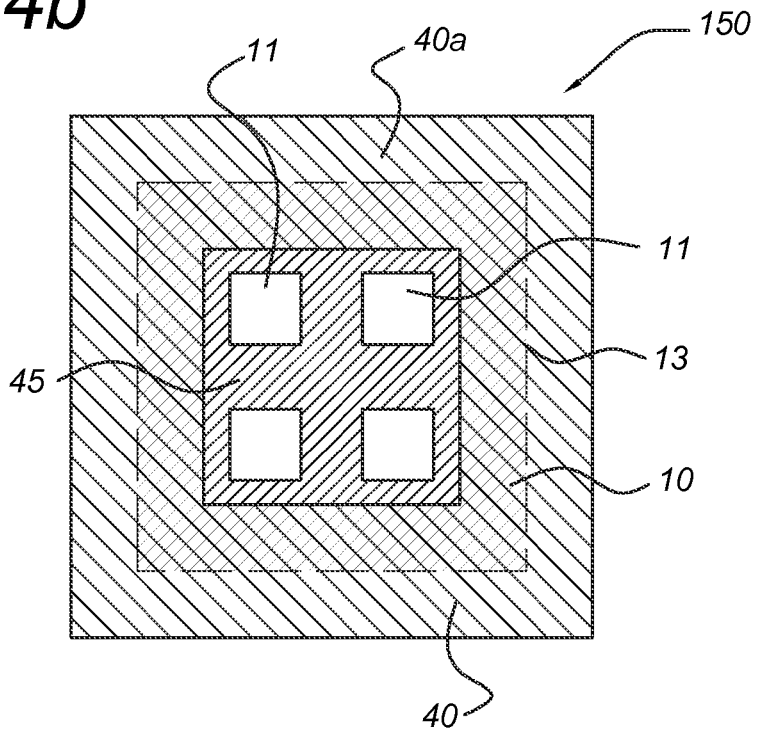

FIG. 4*b* schematically depicts an embodiment of the lighting unit 10, seen from above, i.e. observing the front face 16 of the lighting unit 10. The front face 16 is provided with release liner unit 40, which extends over the edge 13. Hence, edge 13 is indicated as dashed line. Note that the release liner unit 40 not necessarily extends over the entire edge 13, but may also only at one or more places extend over the edge 13. Here, an embodiment of the release liner unit 40 is depicted, wherein there is an opening 45 in the release liner unit to allow light of the lighting unit 10 pass the release liner unit 40. In another embodiment, the release liner unit 40 may be transparent, and no opening 45 is necessarily needed. Hence, in this embodiment, the (optional) opening 45 is used to allow light of light source(s) 11 travel to the cover front face 26 (not shown here), substantially uninhibited by the release liner unit 40. Hence, FIG. 4*b* schematically depicts an embodiment of the combination 150 of lighting unit 10 and release liner unit 40.

Figure 4C:
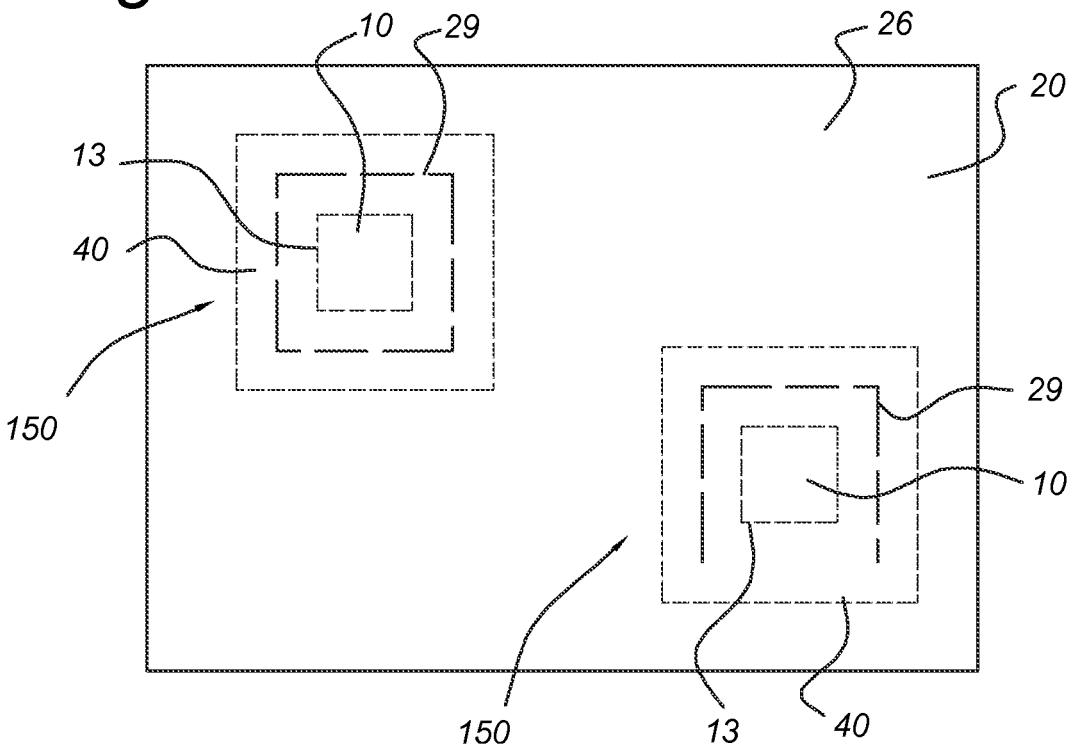

FIG. 4*c* then schematically depicts the entire stack arrangement 100, based on the above described and in FIGS. 4*a*-4*b* schematically depicted embodiments, and seen form above (i.e. for instance a user (standing on) and looking to the support cover front face 26). Hence, the stack arrangement 100 is seen from the cover front face 26. For illustration purposes, the combination 150 of lighting unit 10 and release liner unit 40 is also shown, with doted lines, since in principle they cannot be perceived through the cover 20. In this embodiment, for both depicted lighting units 10 (or lighting unit systems 150), the release liner unit 40 extends over the complete edge 13 of the lighting unit 10.

Further, by way of example, incisions 29 are shown. In the top left example, an incision 29 is circumferential surrounding the lighting unit 10 (but within the boundaries of the release liner unit 40). The circumferential incision allows removal of part of the cover 20 and access to the lighting unit 10. In the bottom right example, the incision 29 is only partially surrounding the lighting unit (but also within the boundaries of the release liner unit 40). Also this type of incision 29 allows access to the lighting unit 10: a flap of the support cover 20 may be opened and access to the lighting unit is obtained.

Figure 5A:
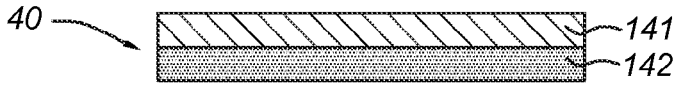
FIGS. 5*a*-5*l* schematically depict some embodiments of the release liner unit, in some instances in a stack arrangement.
Figure 5B:
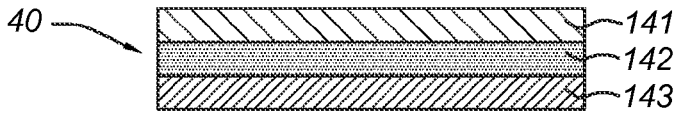

FIGS. 5*a*-5*l* schematically depict some embodiments of the release liner unit 40. FIG. 5*a* schematically depicts a basic embodiment of the release liner unit 40, assuming an adhesive based release liner unit 40. Here, the release liner unit comprises a liner 141 ("first part") with adhesive layer 142 ("second part"). The release liner 141 is releasable from the adhesive layer 142. FIG. 5*b* schematically depicts an embodiment, wherein the release liner unit 40 is also adhesive based, but comprises three parts: a liner 141 ("first part"), an intermediate adhesive layer 142 and a substrate (layer) 143 ("second part"). Again, the release liner 141 is releasable from the adhesive layer 142. Now, these basic embodiments can be arranged within the stack arrangement 100 in a number of ways. Some are schematically depicted in FIGS. 5*c*-5*j*.

Figure 5C:
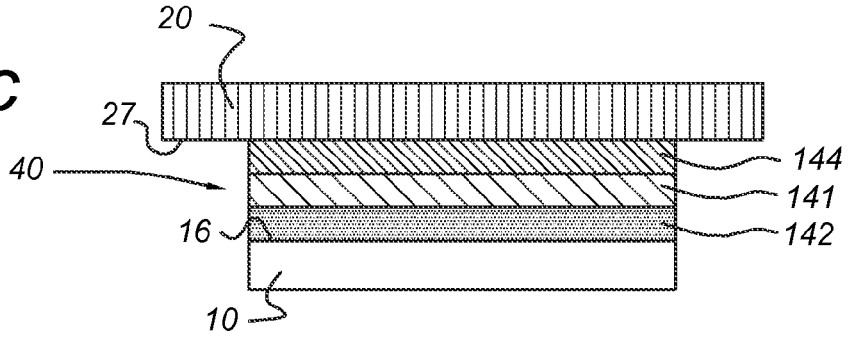

FIG. 5*c* schematically depicts an embodiment of part of the stack, wherein the release liner unit embodiment of FIG. 5*a* is applied, with the release liner 141 being adhesively connected with an adhesive layer 144 to cover 20 (to cover support face 27). The adhesive layer 142 attaches the release liner unit 40 to the lighting unit 10 (to front face 16 of the lighting unit 10). Note that this figure is an example of a configuration. Similarly, such configuration of the release liner unit 40 might be applied as connection between the support 30 and the lighting unit 10. Further, for both applications, the release liner unit 40 may be arranged "upside down" relative to the present configuration. For FIG. 5*c*, this would imply that the following order is obtained: lighting unit 10, adhesive layer 144, release liner 141, adhesive layer 142, and cover 20. Further, the adhesive between the liner 141 and the support cover 20 is indicated with reference 144. However, this adhesive may be the same adhesive as adhesive 70 which is used to adhere support cover 20 and support 30 (see FIGS. 2*b*-2*d* and 3*b*-3*c*).

Figure 5D:
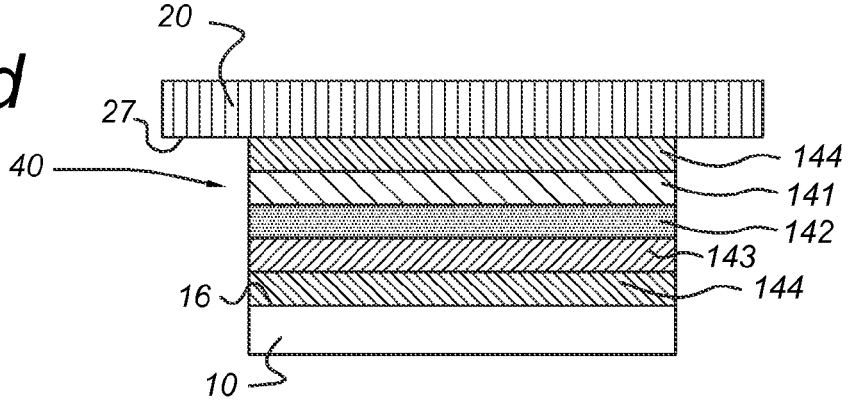

FIG. 5*d* schematically depicts an embodiment of stack 100, wherein the release liner unit embodiment of FIG. 5*b* is applied, with the release liner 141 being adhesively connected with a (first) adhesive layer 144 to cover 20. The (second) adhesive layer 144 attaches the release liner unit 40, more especially substrate 143, to the lighting unit 10. Note that this figure is an example of a configuration. Similarly, such configuration might be applied as connection between the support 30 and the lighting unit 10. Further, for both applications, the release liner unit 40 may be arranged "upside down" relative to the present configuration. For FIG. 5*d*, this would imply that a the following order is obtained: lighting unit 10, (first) adhesive layer 144, release liner 141, adhesive layer 142, substrate 143, (second) adhesive layer 144, and cover 20. Again, adhesive 40 may be the same adhesive as adhesive 70.

Figure 5E:
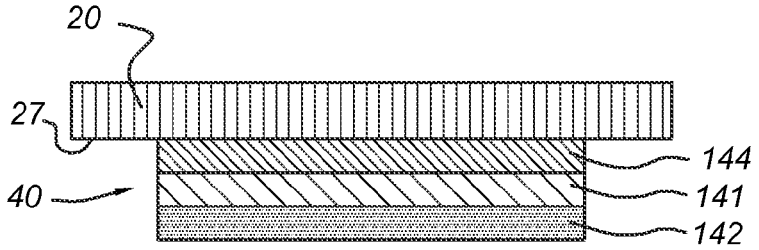
Figure 5F:
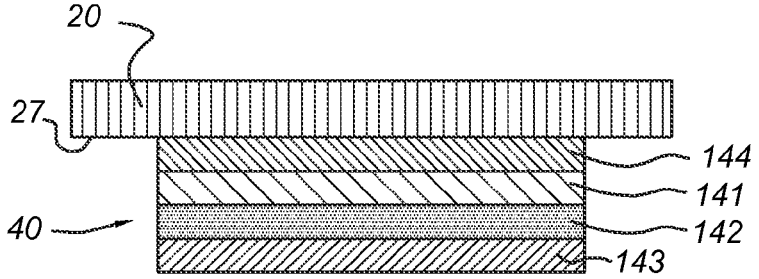
Figure 5G:
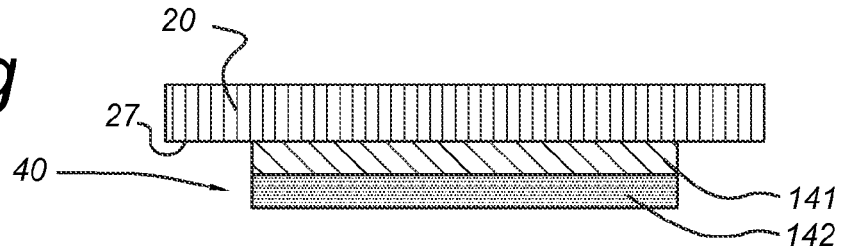

FIGS. 5*e*-5*g* schematically depict embodiments of the cover 20 with release liner unit 40 attached to cover support face 27.

In FIG. 5*e*, an embodiment is depicted wherein the release liner embodiment of FIG. 5*a* is applied, in such a configuration that the release liner 141 is attached to the support cover 20 with adhesive layer 144. In this embodiment, the support cover can also be interpreted as substrate.

In FIG. 5*f*, an embodiment is depicted wherein the release liner embodiment of FIG. 5*b* is applied, in such a configuration that the release liner 141 is attached to the support cover 20 with adhesive layer 144. In FIG. 5*f*, by way of example sticky adhesive layer 142 is by way of example protected with substrate 143. When applying the cover 20 to the lighting unit 10 (not shown), either the substrate 143 may be removed, or typically an adhesive layer 144 may be applied between the substrate 143 and the lighting unit 10.

FIG. 5*g* schematically depicts a variation on the embodiment schematically depicted in FIG. 5*e*. In FIG. 5*g*, the adhesive layer 142 is used to attach the release liner unit 40 to the cover 20. When applying the cover 20 to the lighting unit 10 (not shown), an adhesive layer 144 may be applied between the release liner 141 and the lighting unit 10 (not shown).

FIGS. 5*c*-5*g* thus schematically depict a non-limiting number of embodiments of support cover 20, preferably selected from the group consisting of wall paper, carpet, PVC flooring and linoleum flooring, preferably having a light transmission in the range of 0.5-30%, especially in the range of 1-20%, for light 15 (not shown) having a wavelength selected from the visible wavelength range, wherein support cover 20 comprises cover front face 26 and an opposite cover support face 27, having a cover support face area, and wherein to at least part of the cover support face 27 release liner unit 40 is attached, wherein the release liner unit 40 preferably has a release liner unit area which is smaller than the cover support face area, and wherein the release liner unit 40 comprise release liner 141 for releasable binding.

Figure 5H:
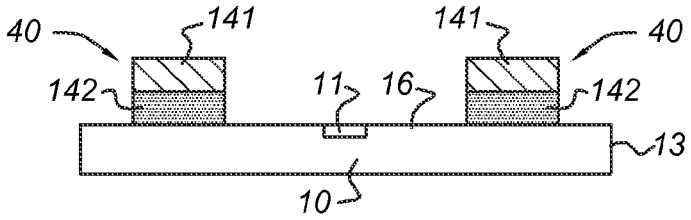
Figure 5I:
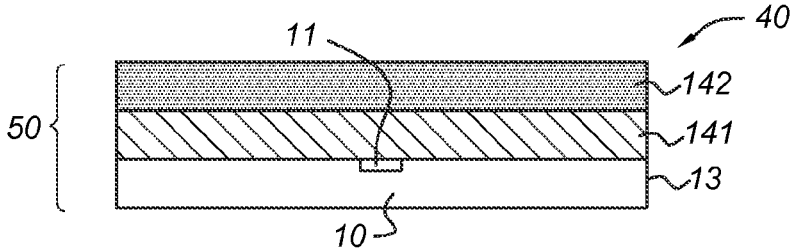
Figure 5J:
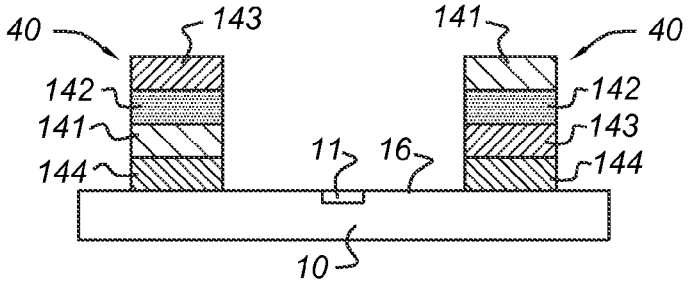

FIG. 5*h*-5*j* schematically depict embodiments of the release liner unit 40 applied to the front face 16 of the lighting unit 10. As mentioned above, the release liner unit 40 may cover the entire surface of the lighting unit 10 and/or may extend over edge 13. The arrangement of the release liner unit 40 in FIG. 5*h* is similar to the arrangement of the release liner unit 40 in FIG. 5*g* (but there to the cover 20).

The arrangement of the release liner unit 40 in FIG. 5*i* is similar to the arrangement of the release liner unit 40 in FIG. 5*h*, but now to the entire front face 16 of the lighting unit 10. In this way, lighting unit system 150 is obtained. Light of light source 11 may escape through the release liner unit 40 because the release liner unit may be transparent (or may comprise apertures).

FIG. 5*j* schematically depicts an embodiment of a release liner unit 40 comprising two release liners 141. The lighting unit system 150 may be provided for use. Before application of the support cover 20, the upper release liner 141 may be removed, whereby the sticky adhesive layer 142 is now the upper layer. When the cover is applied to the lighting unit system 150, the support cover 20 and the lighting unit 10 are bonded to each other via the release liner unit, but in a releasable way, since both items may be detached by loosening the support cover with adhesive 141 from the remaining release liner 141 (which is in this embodiment attached to the lighting unit with adhesive layer 144).

FIGS. 5*h*-5*j* thus schematically depict a non-limiting number of embodiments of the lighting unit system 150 comprising lighting unit 10 with front face 16 and back face 17, wherein lighting unit 10 is configured to provide light 15 (not shown) travelling in a direction away from front face 16, and wherein release liner unit 40 is attached to front face 26, wherein release liner unit 40 comprises release liner 141 for releasable binding.

Figure 5K:
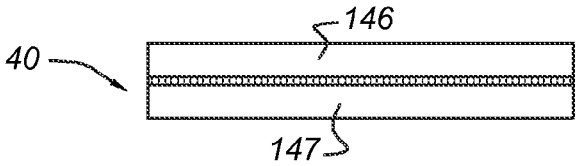

FIG. 5*k* schematically depicts an embodiment of the release liner unit 40 based on Velcro. The release liner unit comprises a first part 146 (for instance hook based) and a second part 147 (for instance loop based). Again, all kind of configurations are possible, both when the release liner unit 40 is applied between cover 20 and lighting unit 10 and/or between lighting unit 10 and support 30. Here, both first part 146 and second part 147 may be considered release liner.

Figure 5L:
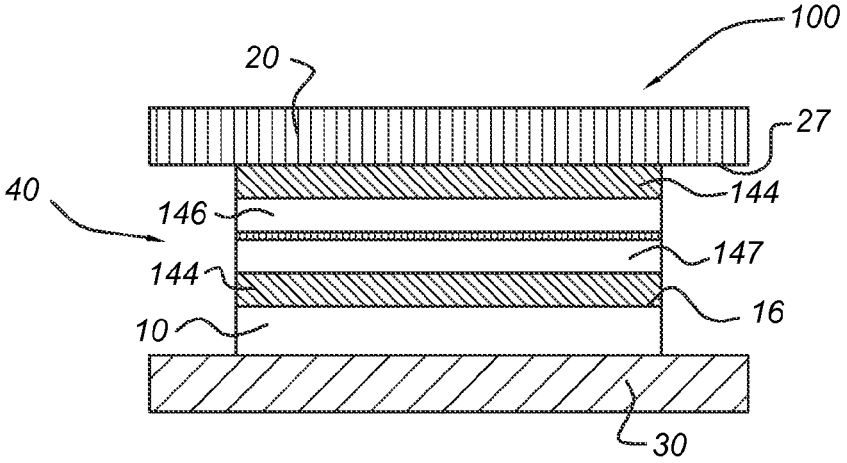

By way of example, an embodiment is schematically depicted in FIG. 5*l*, wherein the release liner unit 40 (Velcro based), is used to connect cover 20 to lighting unit 10. Here, a (first) adhesive layer 144 is applied between cover 20 and release liner unit 40 (first part 146), and a (second) adhesive layer 144 is applied between the release liner unit 40 (second part 146) and the lighting unit 10.

The term "substantially" herein, such as in "substantially all emission" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A stack arrangement comprising a support and a support cover, adhesively bonded to the support, the arrangement further comprising a lighting unit arranged at a position between the support and the support cover, the lighting unit being configured to provide light through the support cover, and wherein the lighting unit is releasably bonded to the support and the support cover using respective release liner units, each release liner unit having two parts, a release liner and a second part, wherein the two parts have a releasable binding between them, and wherein one part is bonded to the lighting unit and the other part is respectively bonded to the support or the support cover.

2. The stack arrangement according to claim 1, wherein the release liner unit extends beyond an edge of the lighting unit.

3. The stack arrangement according to claim 1, wherein the support is a wall and wherein the support cover comprises wall paper or wherein the support comprises a floor or a wall and wherein the support cover comprises a carpet.

4. The stack arrangement according to claim 1, wherein the support cover has a light transmission in the range of 0.5-30%, for light generated by the lighting unit and having a wavelength selected from the visible wavelength range.

5. The stack arrangement according to claim 1, wherein the release liner unit is adhesive based.

6. A method for the production of a stack arrangement according to claim 1, comprising providing a support, a lighting unit, a support cover, and two release liner units, wherein each release liner unit having two parts, a release liner and a second part, wherein the two parts have a releasable binding between them, arranging the lighting unit at a position on the support and forming the stack arrangement of the support and support cover by adhesively binding the support and support cover to each other and (a) releasable binding the support and the lighting unit via the release liner unit, wherein respective parts of the release liner unit are bonded to the support and lighting unit, or (b) releasable binding the lighting unit and the support cover via the release liner unit, wherein respective parts of the release liner unit are bonded to the support cover and lighting unit, or (c) releasable binding the support and the lighting unit via a release liner unit and releasable binding the lighting unit and the support cover via a release liner unit, wherein respective parts of the release liner units are bonded to the support, support cover and lighting unit.

7. A method of approaching a support cover hidden lighting unit in a stack arrangement according to claim 1, comprising:

creating an incision in the support cover over a lighting unit;

releasing the lighting unit from the support, or from the support cover or from both the support and the support cover by releasing the release liner(s); and accessing the lighting unit.

8. The method according to claim 7, further comprising:

removing the lighting unit from its lighting unit position and arranging the same or another lighting unit to the lighting unit position and binding the support and lighting unit;

binding the support cover and the lighting unit, via a release liner unit; and connecting the parts of the support cover that were separated by the incision.

* * * * *